US008904834B2

(12) United States Patent
Finkelstein et al.

(10) Patent No.: US 8,904,834 B2
(45) Date of Patent: Dec. 9, 2014

(54) LOCKABLE STRIKE FOR WALK-IN COLD ROOMS

(71) Applicant: Kason Industries, Inc., Newnan, GA (US)

(72) Inventors: Burl M Finkelstein, Newnan, GA (US); Brett A Mitchell, Newnan, GA (US); Raymond J Hiller, Newnan, GA (US)

(73) Assignee: Kason Industries, Inc., Newman, GA (US)

( * ) Notice: Subject to any disclaimer, the term of this patent is extended or adjusted under 35 U.S.C. 154(b) by 40 days.

(21) Appl. No.: 13/663,661

(22) Filed: Oct. 30, 2012

(65) Prior Publication Data

US 2013/0047686 A1 Feb. 28, 2013

Related U.S. Application Data

(63) Continuation-in-part of application No. 11/751,859, filed on May 22, 2007, now abandoned.

(51) Int. Cl.

| | |
|---|---|
| ***E05B 65/06*** | (2006.01) |
| ***E05C 1/10*** | (2006.01) |
| ***E05B 21/06*** | (2006.01) |

(52) U.S. Cl.

CPC .. *E05B 21/06* (2013.01); *E05C 1/10* (2013.01)
USPC ..... 70/134; 70/211; 292/92

(58) Field of Classification Search

USPC ..... 70/134, 211–212; 292/92
See application file for complete search history.

(56) References Cited

U.S. PATENT DOCUMENTS

| | | | | |
|---|---|---|---|---|
| 4,280,725 | A * | 7/1981 | Berkowitz et al. | 292/223 |
| 6,318,770 | B1 * | 11/2001 | Molzer | 292/336.3 |
| 6,526,788 | B2 * | 3/2003 | Finkelstein et al. | 70/129 |
| 7,484,390 | B1 * | 2/2009 | Finkelstein et al. | 70/212 |
| 7,836,737 | B2 * | 11/2010 | Lin | 70/116 |
| 7,849,719 | B2 * | 12/2010 | Chern | 70/104 |
| 8,001,813 | B1 * | 8/2011 | Turnbo | 70/129 |
| 8,534,722 | B2 * | 9/2013 | Schmid et al. | 292/341.17 |
| 8,601,839 | B1 * | 12/2013 | Liu | 70/86 |
| 2007/0119220 | A1 * | 5/2007 | Maquet | 70/212 |
| 2010/0212378 | A1 * | 8/2010 | Chen et al. | 70/211 |

* cited by examiner

*Primary Examiner* — Suzanne Barrett
(74) *Attorney, Agent, or Firm* — Baker Donelson; Dorian B. Kennedy

(57) ABSTRACT

A lockable strike for walk-in cold rooms includes a housing that has a mounting plate, a cover and a deadbolt moveably engaged therein to reciprocally move along a path of travel between an extended position and a retracted position with respect to the housing. The mounting plate includes a base and a bridge defining a tongue channel through which the deadbolt travels. The mounting plate base is made of a metal for strength while the cover is made of a plastic for thermally insulative purposes.

10 Claims, 5 Drawing Sheets

LOCKABLE STRIKE FOR WALK-IN COLD ROOMS

REFERENCE TO RELATED APPLICATION

This is a continuation-in-part of U.S. patent application Ser. No. 11/751,859 filed May 22, 2007 and entitled Lockable Strike for Walk-in Cold Rooms.

TECHNICAL FIELD

This invention relates to walk-in cold rooms, and specifically to a lockable strike for walk-in cold rooms.

BACKGROUND OF INVENTION

Walk-in cold rooms, such as walk-in coolers, freezers, or other refrigerated environments, are common in various industries, including supermarkets and grocery stores, commercial kitchens, and other food service facilities. They typically have one or more access doors for entry and exit from the environment. Since these environments are often used to store valuable contents, such as expensive products and/or large quantities of products, it is typically desirable that the access door(s) can be locked to control and/or restrict access to such contents. For example, to control access, the availability of a keyed locking option may be desirable so that keys can be provided to personnel who are authorized to access the cold-room environment. As another example, to restrict access during certain times, the availability of an alternate or additional locking option may be desirable so that even authorized personnel cannot access the cold-room environment. There may also be other reasons to control and/or restrict access to walk-in cold rooms such as safety or maintenance.

A problem with these locks is that in order for the locks to be built to endure the loads placed upon them, the lock must be ruggedly built. This criteria typically results in a lock strike being made of all metal components. Metal components however are thermally conductive, resulting in the lock strike becoming cold. The coldness of the lock strike may create condensation, which may cause a safety hazard on the floor should it drip, or cause the lock strike to become inoperable should it freeze.

Accordingly, it is seen that a need exists for a lockable strike for walk-in cold rooms that is strong yet restricts thermal conductivity to the exterior components of the lockable strike. It is to the provision of such therefore that exemplary embodiments of the present invention are primarily directed.

SUMMARY OF INVENTION

A lockable strike for walk-in cold rooms comprises a housing including a bottom mounting plate and a guide bridge extending from the bottom mounting plate defining a guide channel, and a locking mechanism including a reciprocally moving deadbolt and a handle coupled to the deadbolt so that movement of the handle causes the movement of the deadbolt. The reciprocally moving deadbolt being mounted for reciprocal movement within the guide channel of the guide bridge. The guide bridge being mounted to abut the deadbolt should a door opening pressure be applied to the deadbolt.

DETAILED DESCRIPTION

Figure 1:
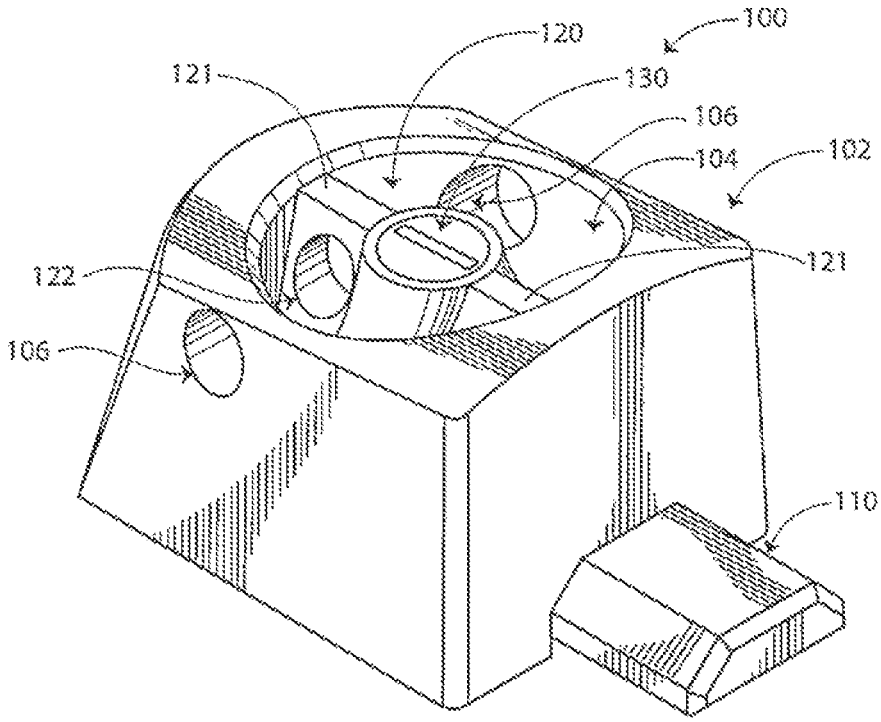
FIG. 1 is a perspective view of a lockable strike for walk-in cold rooms.

With reference to the drawings, FIG. 1 is a perspective view of a lockable strike 100 for walk-in cold rooms. The lockable strike 100 may, for example, be used in conjunction with a handle attached to a door of a walk-in cold room to control and/or restrict opening of the door to access the walk-in cold room. The lockable strike 100 includes a housing or body 102 with a cover 103 that has a recessed portion or well 104 and one or more holes or opening 106 that extends through a portion of the housing that defines the well 104.

The lockable strike 100 also includes a knob 120 that is at least partially positioned within the well 104. The knob 120 includes one or more gripping portions 121 that facilitate rotational operation of the knob 120. Knob gripping portions 121 include one or more holes 122 therethrough which are alignable with housing holes, the holes are all aligned along a lock path. It is noted that, among other benefits, the positioning of the knob 120 within the well 104 can provide an effective seal that prevents dirt, debris, and/or other undesirable materials from entering the housing 104 and, for example, contaminating the walk-in cold room, or allowing an undesirable loss of cooling from the cold room.

A cylinder lock 130 is positioned within a central portion of the knob 120. The cylinder lock 130 provides another manner of locking the lockable strike 100. The lockable strike 100 includes a reciprocating tongue or deadbolt 110, which can be extended and retracted within the housing 102 by operation of the knob 120 and also locked in one or more of these positions. As will be apparent, the deadbolt 110 can facilitate the locking or unlocking capability of the lockable strike 100. The term deadbolt as used herein has a very specific definition, which is a lock bolt that is positively driven by a handle, knob or other device, in other words, the deadbolt must be physically forced through a handle or knob to move it from one position to the other. This prevents someone from merely inserting a tool between the door and jamb and forcing the deadbolt to a retracted position by contacting and pushing upon the bolt with the tool. Deadbolts are not spring loaded and can not be retracted by force against the bolt when in the engaged position, although a spring may be coupled to the deadbolt simply to reduce the amount of force necessary to actuate the handle. By preventing retraction the deadbolt provides a security measure on a closed door. The term deadbolt does not include a slam latch which is a latching device with a spring loaded bolt or tongue that retracts upon striking the door jamb or strike and extends when the bolt is released.

Figure 2A:
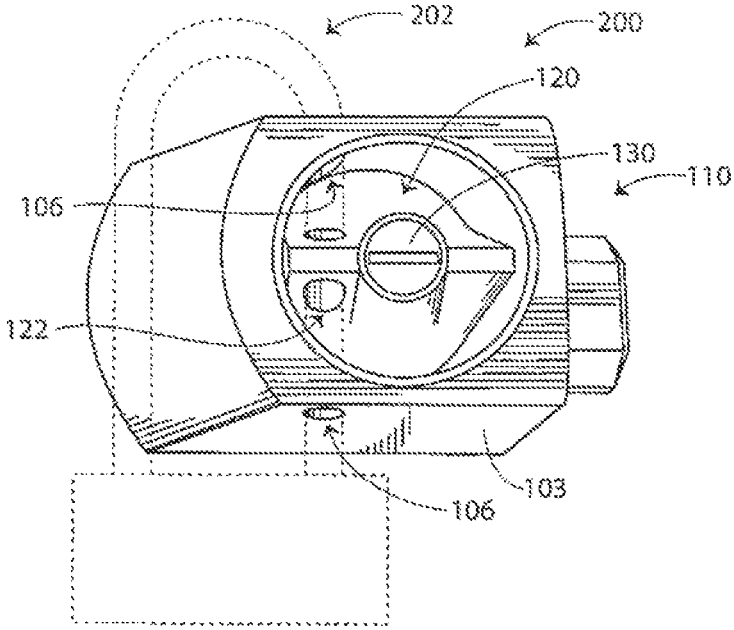
FIGS. 2A and 2B are front perspective views showing a locking capability of the lockable strike for walk-in cold rooms shown in FIG. 1 in a locked and unlocked configuration respectively.
Figure 2B:
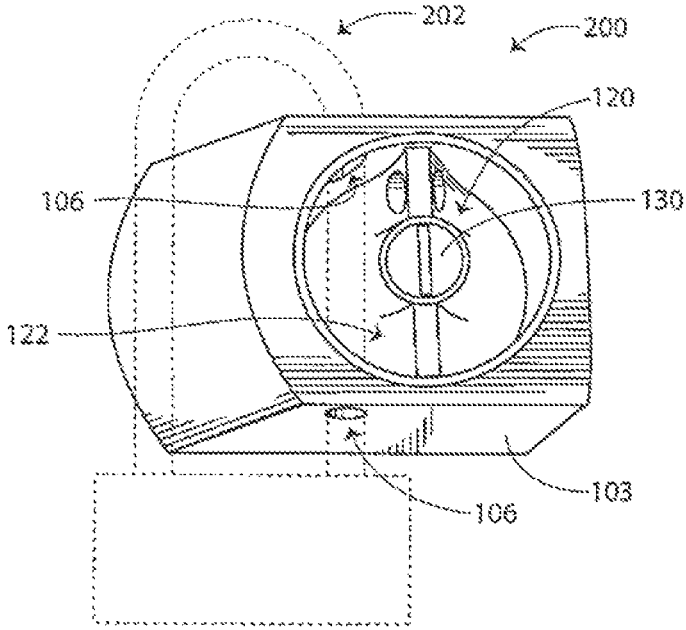

FIGS. 2A and 2B are front perspective views 200 showing a locking capability of the lockable strike 100 for walk-in cold rooms shown in FIG. 1 in a locked and unlocked configuration respectively. A locking device 202, such as a padlock is shown with a shackle that extends through the housing holes 106 and also through the knob hole 122, along the lock path, thereby locking the knob 120 in a locked position where the deadbolt 110 is also extended in a locked position. Thus, the locking device 202 can be used to lock the lockable strike 100 while it is in a locked configuration with the deadbolt 110 extended.

Moreover, as depicted in FIG. 2B, the locking device 202 can alternately be extended through the holes 106 of the housing 102 while the knob 120 is positioned such that the lockable strike 100 is in an unlocked configuration with the deadbolt 110, where the deadbolt 110 is retracted. As shown, in such locked configuration, the radially extending portions 121 of the knob 120 are restricted from moving past the locking device 202 thereby restricting the operation of the knob 120 and thus the lockable strike 100. It should be understood that other devices that, for example, can be extended through the holes 122, 106, can be utilized for the locking device 202 to lock the lockable strike 100 in the locked or unlocked configurations. Thus, the holes 106, 122 can facilitate at least one way of locking the lockable strike 100 in a locked or unlocked configuration.

Figure 3A:
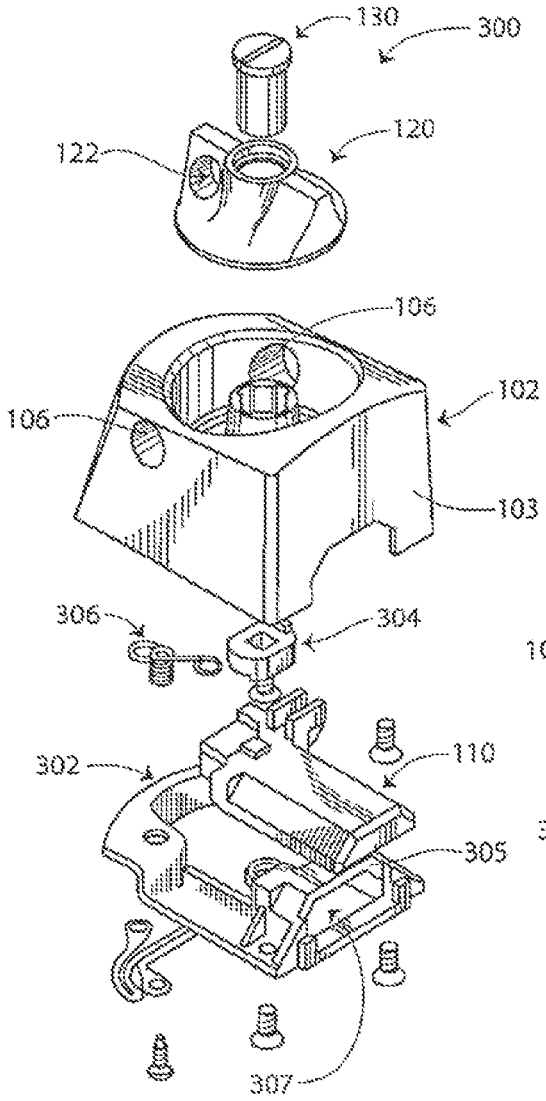
FIGS. 3A and 3B are exploded perspective views of the lockable strike for walk-in cold rooms shown in FIG. 1.
Figure 3B:
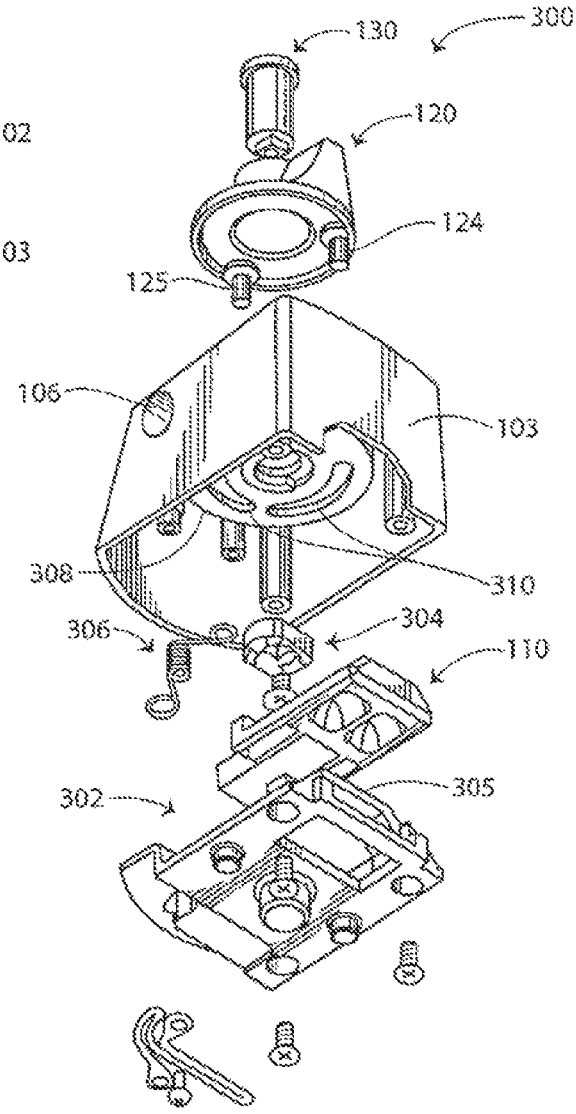

FIGS. 3A and 3B are exploded perspective views 300 of the lockable strike 100 for walk-in cold rooms shown in FIG. 1. The lockable strike housing also includes a bottom plate 302, which further house and/or support various components of or related to the lockable strike 100, and a cylinder stop 304 which in conjunction with the cylinder lock 130 enables the strike to be in a locked and/or unlocked configuration. The bottom plate 302 includes a pair of guide rails 303 positioned on either side of deadbolt 110 and a guide bridge or bracket 305 defining a guide channel or passageway 307 through which the deadbolt 110 extends. The bracket 305 directly covers a portion of the deadbolt 110, the term directly covers as used herein is intended to mean that it is positioned directly over and in very close proximity to the deadbolt without any other structure being positioned between the bracket and the deadbolt, as such the term cover is not intended to denote a mere positioning vertically over a component. The guide rails 303 aid in guiding the deadbolt through the channel 307 of the guide bridge 305. The bottom plate 302 may be made of a metallic material to provide strength while the remaining portions (cover) of the housing may be made of a thermally insulative material, such as a plastic, to restrict thermal conductivity. The bottom plate 110 is made of a metallic material so that a load placed upon the lock strike (load upon an attempted opening of a locked door), and thus the deadbolt, is applied directly to the strong bottom plate. In other words, should someone attempt to force the locked door open, the deadbolt is forced against the bridge 305, which translates the force to the entire metal bottom plate 110. The guide rails 303 aid in guiding the deadbolt in a straight path. Furthermore, a spring 306 is depicted that can facilitate the operation of the lockable strike 100 between a locked and unlocked configuration. The spring 306 can be connected between one or more portions of the knob 120, the cylinder lock 130, and/or the housing in a manner (e.g., under tension or compression) such that it assist in the movement of the knob 120, cylinder lock 130, and/or other components of the lockable strike 100, between a locked and unlocked configuration.

Also depicted in FIG. 3B are knob pins 124, 125, which can facilitate the operation of the deadbolt 110 between a locked and unlocked configuration. A knob guide 308 is also included in FIG. 3B, which includes arcuate slots 310 therethrough with which the knob pins 124,125 can moveably engage to translate rotational operation of the knob 120 to the deadbolt 110.

Figure 4A:
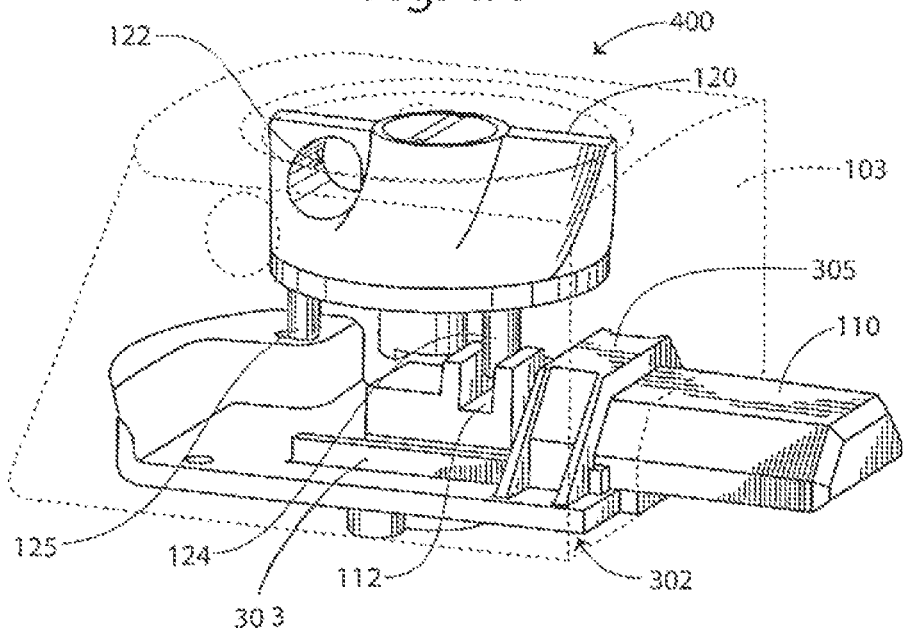
FIGS. 4A and 4B are internal views of the lockable strike for walk-in cold rooms shown in FIG. 1 in a locked and unlocked configuration respectively including a knob mechanism.
Figure 4B:
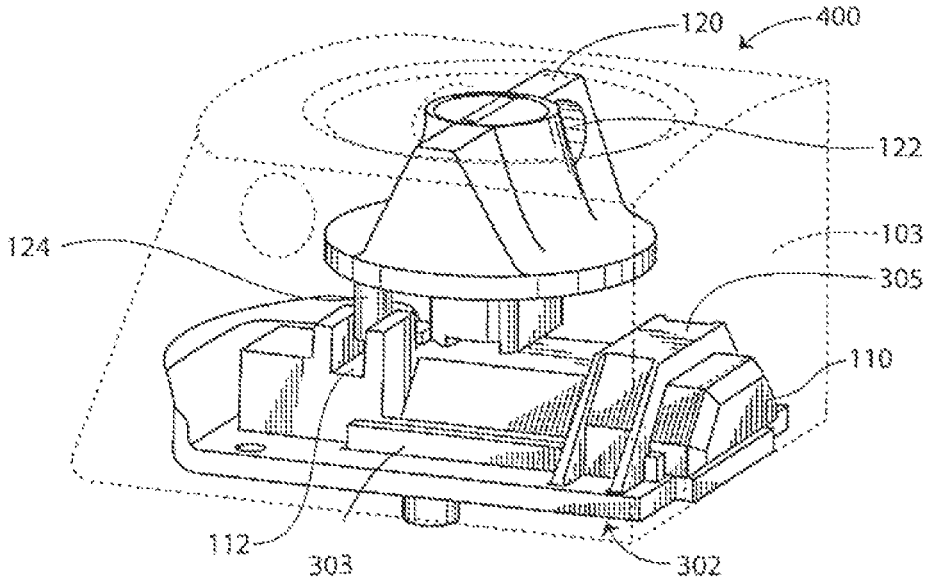

FIGS. 4A and 4B are internal views 400 of the lockable strike 100 for walk-in cold rooms shown in FIG. 1 in a locked and unlocked configuration respectively including the knob 120 and related components. An actuating groove or channel 112 is shown in mating engagement with the knob pin 124 so that the deadbolt 110 is extended to a locked configuration or retracted to an unlocked configuration when the knob 120 is operated. For example, with respect to FIG. 4A, if the knob 120 is rotated clockwise (e.g., approximately 90 degrees), then the deadbolt 110 is retracted to the position depicted in FIG. 4B and vice versa. It is thus by this interaction of the knob 120 and the deadbolt 110 (i.e., via the knob pin 124 and actuating groove 112) that restricting the operation of the knob 120 (e.g., via a padlock or other locking device 202) can in turn restrict the lateral movement of the deadbolt 110 between a locked or unlocked configuration. It should be understood that the knob may be designed to rotate in the opposite direction as that described in the preferred embodiment.

Figure 5A:
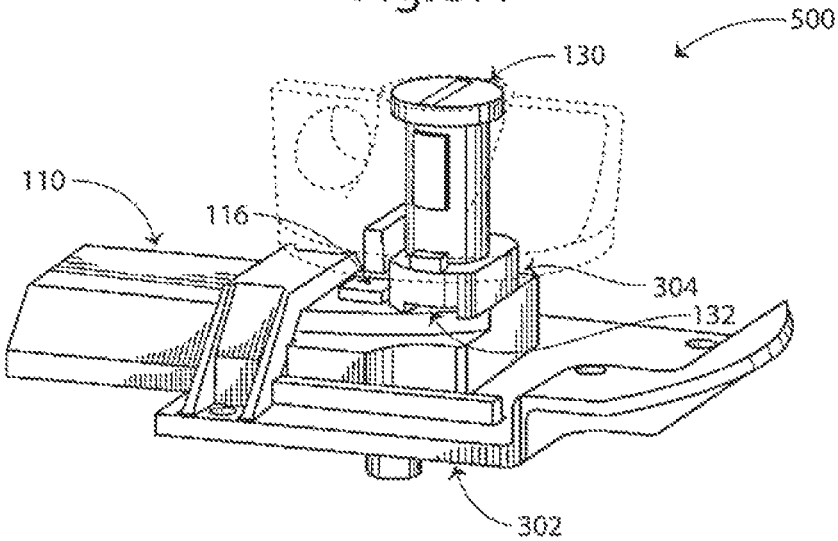
FIGS. 5A and 5B are alternate internal views of the lockable strike for walk-in cold rooms shown in FIG. 1 in a locked and unlocked configuration respectively including a cylinder mechanism.
Figure 5B:
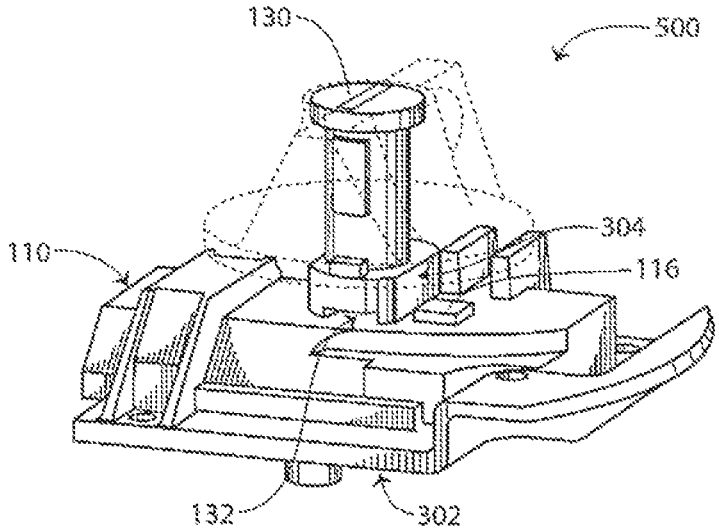

FIGS. 5A and 5B are additional internal views 500 of the lockable strike 100 for walk-in cold rooms shown in FIG. 1 in a locked and unlocked configuration respectively. In addition to the previously described components, the strike 100 further includes a deadbolt stop 116 which extends from the top surface of the deadbolt 110 and a rotatable cylinder stop 304 coupled to the cylinder lock 130 and having a stop tunnel 132 therein. The cylinder stop 304 is configured to allow the deadbolt stop 116 to pass thereunder when the cylinder lock 130 is positioned appropriately. As also depicted in FIGS. 5A and 5B, the cylinder stop 304 can restrict the reciprocal, lateral movement of the deadbolt 110 via the deadbolt stop 116 engaging the cylinder stop 304 (e.g., when the cylinder lock 130 is in a locked position) and thereby restrict the deadbolt 110 to an extended (e.g., locked) or retracted (e.g., unlocked) configuration. However, when the cylinder lock 130 is actuated accordingly such that the stop tunnel 132 is aligned with the deadbolt stop 116 (e.g., when the cylinder lock 130 is in an unlocked position), the deadbolt 110 can be moved laterally via the knob 120 between an extended and retracted configuration. It is thus by this interaction of the cylinder lock 130 and the deadbolt 110 (i.e., via the cylinder stop 304 and deadbolt stop 116) that operation of the cylinder lock (e.g., between a locked and unlocked position, e.g., using a key) can in turn restrict the lateral movement of the deadbolt 110 in, for example, a locked or unlocked configuration as discussed above.

Therefore, in light of the foregoing, it can be seen that exemplary embodiments of the lockable strike described herein can allow a user to control and/or restrict access to walk-in cold rooms. For example, a user can control access to a cold room environment using the lockable strike 100 by providing one or more keys to the cylinder lock 130 to personnel who are authorized to access the cold room, thus limiting access to these authorized personnel. Yet, as another example, a user can restrict access to the cold room using the lockable strike 100 by installing a locking device 202 through the housing holes 106 and the knob hole 122 thereby restricting movement of the knob 120 while the deadbolt 110 is in a locked configuration so that even authorized personnel with a key to the cylinder lock 130 cannot access the cold-room environment. Additionally, as discussed above, a user can control or restrict the lockable strike 100 to an unlocked configuration by the foregoing methods via the cylinder lock 130 and/or the knob 120 and a locking device 202.

It should also be understood and/or otherwise apparent that such elements of exemplary embodiments of the invention may be constructed in numerous forms, shapes, sizes, etc. of numerous materials, compositions, formations, etc., using numerous methods, processes, procedures, etc. For example, exemplary embodiments of the invention may include elements that are constructed of plastic or other non-metallic materials, which may, for example, also offer the benefit of reduced thermal conduction (e.g., between the cold room and the adjacent environment) and lower the costs to manufacture. It should also be understood that the strike may be releasably mounted to the door jamb for safety reasons, as with a threaded rotatable knob extending to the strike from the interior of the cool room.

It should be understood that as used herein the term lateral, laterally, laterally moving, lateral movement or the like is intended to denote a straight, sideways movement of the deadbolt and is not intended to include a pivotal movement of the deadbolt even if such pivotal movement incorporates a lateral component or offset.

It should be understood that the foregoing descriptions merely relate to exemplary, illustrative embodiments of the invention. Therefore, it should also be understood that various modifications may be made to exemplary embodiments described herein that are within the scope of the invention, which will be recognized by one of ordinary skill in the art in light of the disclosure herein. Furthermore, various elements of the described exemplary embodiments of the invention may be known in the art or recognized by one of ordinary skill in the art based on the disclosure herein.

The invention claimed is:

1. A lockable strike for walk-in cold rooms, comprising, a housing including a bottom mounting plate and a guide bridge extending from said bottom mounting plate and defining a guide channel, said bottom mounting plate includes a pair of guide rails oriented to guide said deadbolt through said guide bridge channel, and a locking mechanism including a laterally reciprocally moving deadbolt and a handle coupled to said deadbolt so that movement of said handle causes the lateral movement of said deadbolt, said laterally reciprocally moving deadbolt being mounted for lateral reciprocal movement within said guide channel of said guide bridge, said guide bridge being configured to overlie said deadbolt and to abut said deadbolt should a door opening pressure be applied to said deadbolt causing said deadbolt to be forced towards said bridge.

2. The lockable strike of claim 1 wherein housing also includes a cover, and wherein said mounting plate is metallic material and wherein said cover is a thermally insulative, non-metallic material, whereby the metallic mounting plate provides strength to maintain the deadbolt in a locked position while under stress and the thermally insulative, non-metallic material restricts thermal conductivity through the lockable strike.

3. The lockable strike of claim 1 further comprising a lock for locking the position of said deadbolt.

4. The lockable strike of claim 3 wherein said lock is a removable lock.

5. The lockable strike of claim 3 wherein said lock is a cylinder lock.

6. A lockable strike for a walk-in cold room structure, comprising:

a mounting plate adapted to be mounted to the walk-in cold room structure, said mounting plate including a bracket, said mounting plate defining a deadbolt passageway passing below said bracket;

a deadbolt tongue adapted for lateral movement through said deadbolt passageway between a locked position and an unlocked position, and a lock coupled to said deadbolt tongue to lock said deadbolt tongue in said locked position, said bracket being configured to overlay said deadbolt tongue while allowing reciprocal lateral movement of said tongue relative to said mounting plate whereby the deadbolt tongue is prevented from moving out of said deadbolt passageway by said bracket.

7. The lockable strike of claim 6 wherein said mounting plate also includes a pair of guide rails oriented to guide said deadbolt tongue through said deadbolt passageway.

8. The lockable strike of claim 6 further comprising a cover coupled to said mounting plate, and wherein said mounting plate is a metallic material and wherein said cover is a thermally insulative, non-metallic material, whereby the metallic mounting plate provides strength to maintain the deadbolt in a locked position while under stress and the thermally insulative, non-metallic material restricts thermal conductivity through the lockable strike.

9. The lockable strike of claim 6 wherein said lock is a removable lock.

10. The lockable strike of claim 6 wherein said lock is a cylinder lock.

* * * * *